US007318430B2

(12) United States Patent
Leven

(10) Patent No.: US 7,318,430 B2
(45) Date of Patent: Jan. 15, 2008

(54) MULTIROD BOW STABILIZER

(75) Inventor: William L. Leven, Canoga Park, CA (US)

(73) Assignee: Leven Industries, Canoga Park, CA (US)

( * ) Notice: Subject to any disclaimer, the term of this patent is extended or adjusted under 35 U.S.C. 154(b) by 0 days.

(21) Appl. No.: 11/324,817

(22) Filed: Jan. 4, 2006

(65) Prior Publication Data

US 2007/0151553 A1 Jul. 5, 2007

(51) Int. Cl.
*F41B 5/20* (2006.01)

(52) U.S. Cl. ..... 124/89

(58) Field of Classification Search ..... 124/89
See application file for complete search history.

(56) References Cited

U.S. PATENT DOCUMENTS 3,524,441 A * 8/1970 Jeffery ..... 124/89
3,628,520 A * 12/1971 Izuta ..... 124/89
4,615,327 A * 10/1986 Saunders ..... 124/89
4,936,283 A * 6/1990 Izuta ..... 124/89
5,090,396 A * 2/1992 Bickel et al. ..... 124/89
5,611,325 A * 3/1997 Kudlacek ..... 124/89
6,431,163 B1 * 8/2002 Chipman ..... 124/89

* cited by examiner

*Primary Examiner*—John A. Ricci
(74) *Attorney, Agent, or Firm*—William L. Androlia; H. Henry Koda

(57) ABSTRACT

A stabilizer for an archery bow including a base housing, end housing and at least one intermediate housing provided on a plurality of rods with a resilient member provided between the rods and the housings surrounding each of the plurality of the rods and in compression such that each rod does not directly engage with the housing and is isolated therefrom by the resilient member.

8 Claims, 4 Drawing Sheets

MULTIROD BOW STABILIZER

BACKGROUND OF THE INVENTION

1. Field of the Invention

The present invention relates accessories to be utilized with archery bows and particularly to stabilizers utilized with archery bows.

2. Prior Art

In the prior art there has existed stabilizers for archery bows. The first of these stabilizers comprise essentially a long aluminum rod which was threaded into the riser of the bow and provided with a weight on the other end. While it provides some beneficial function, it had many drawbacks and disadvantages. Next, the stabilizer was made from carbon fiber which incorporated a vibration absorbing device and example of such a device is U.S. Pat. No. 5,273,022. While this device provided more beneficial use, it too had certain disadvantages.

Another type of stabilizer which was developed instead of the single rod type is commonly referred to as a multirod stabilizer. The examples of these kinds of multirod stabilizers are in U.S. Pat. No. 5,090,396; 5,611,325; and 6,431,163. While these multirod stabilizers provided some additional beneficial effects, they too had disadvantages. In particular, they were typically of complex construction which meant that after long use they tended to come apart and the parts thereof shifted in their location. Shifting their location of the parts caused a change in the tune of the stabilizer with a resulting change in the tune of the whole archery bow system. As a result, when there was a shift in part of the stabilizer, the entire archery bow would begin to shoot its arrows differently, which meant that the arrows would strike a target at different places than they did previously.

SUMMARY OF THE INVENTION

Accordingly, it is the general object of the present invention to provide a multirod stabilizer for archery bow which overcomes the disadvantages of the prior art while providing substantial damping.

It is another object of the present invention is to simplify the construction of the multirod stabilizer.

It is still another object of the present invention is to provide a multirod stabilizer which does not come apart with extended use.

It is still further an object of the present invention to provide an archery bow stabilizer wherein even if some parts become loose, the parts do not shift in their location.

In keeping with the principles of the present invention, the objects are accomplished by a unit stabilizer for an archery bow. The stabilizer includes a base housing, at least one intermediate housing, at least one end housing and a plurality of longitudinally extending rods extending from the base housing, through the at least one intermediate housing and to the end housing. The base housing includes a coupling for coupling the base housing to a riser of the archery bow, a plurality of longitudinal bores provided in the base housing, a plurality of rods wherein an end of each of the plurality of rods inserted into one of the plurality of longitudinal bores in the base housing wherein a diameter of each of the plurality of rods is less than a diameter of each of the plurality of longitudinal bores, a resilient means provided in each of the plurality of bores surrounding each of the plurality of rods wherein the resilient means is in compression so as not only to engage inside surface of the bore but also to engage an outside surface of the rod such that the outside surface of the rod does not directly engage with the inside surface of the bore. The intermediate housing also has a plurality of bores through which a plurality of rods extend with the diameter of each of the plurality of rods wherein the diameter of each of the plurality of the rods is less than the diameter of each of the plurality of longitudinal bores and a resilient member provided in each of the plurality of bores in the intermediate housing surrounding each of the plurality of rods with each of the resilient members being in compression so as not only to engage an inside surface of the bore but also to engage an outside surface of the rod such that the outside surface of the rod is not directly engaged with the inside surface of the bore in the intermediate housing. The end housing has a plurality of bores into which an end of the plurality of the rods is inserted wherein the diameter of each of the plurality of the rods is less than a diameter of the plurality of bores provided in the end housing and the resilient members provided in each of the plurality of bores surrounding each of the plurality of the rods with each of the resilient members being in compression so as not only to engage an insider surface of the bore but also to engage an outside surface of the rod such that the outside surface of the rod does not engage directly with the inside surface of the bore.

BRIEF DESCRIPTION OF THE DRAWINGS

The above-mentioned features and objects of the present invention, as well as other features and objections of the present invention, will become more apparent with reference to the following description taken together with the accompanying drawings wherein like reference numerals denote like elements and in which.

DETAILED DESCRIPTION OF THE INVENTION

Figures 1, 2, 3, 4:
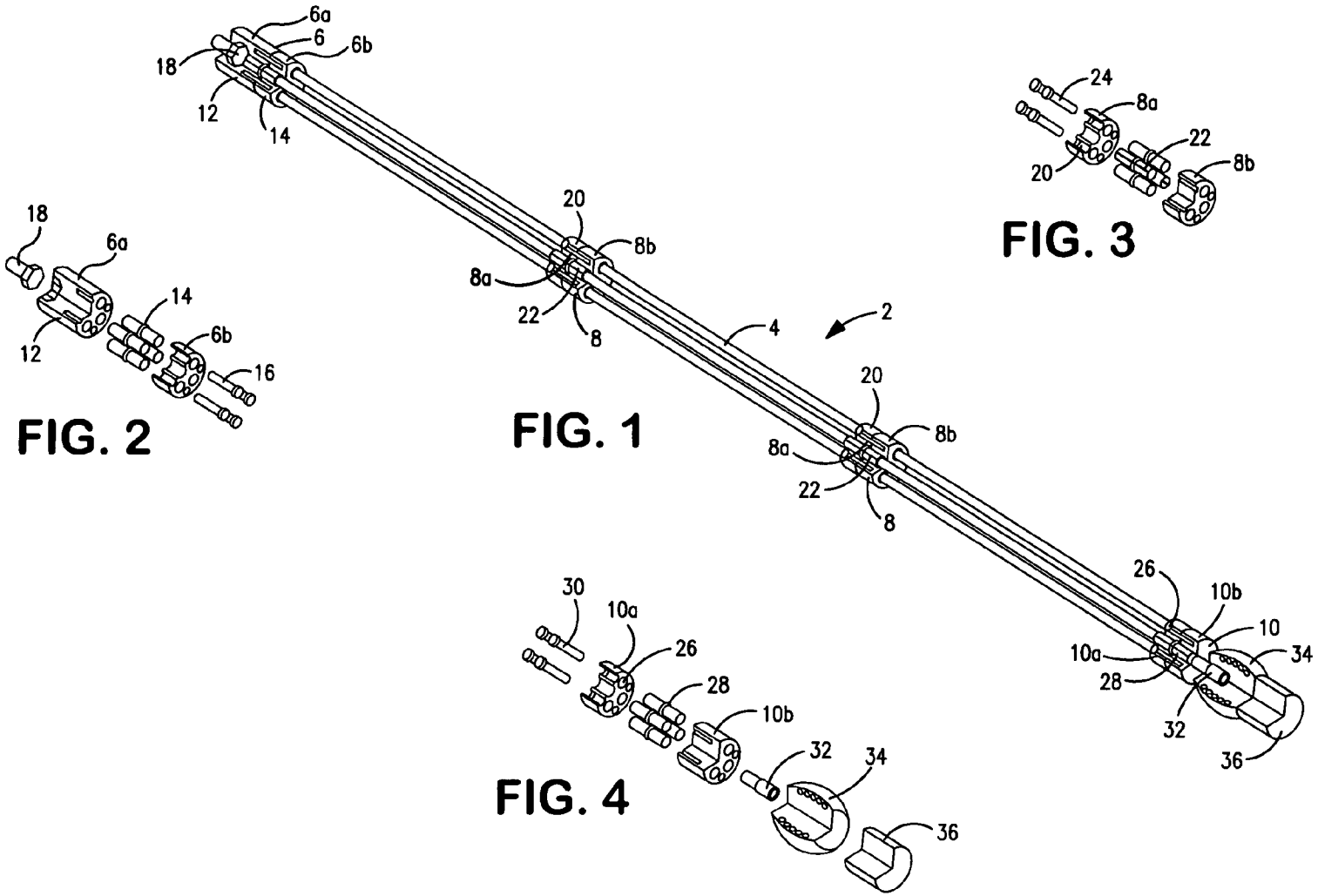
FIG. 1 is an assembled view of a multirod stabilizer in accordance with the teachings of the present invention.
FIG. 2 is an exploded view of the base housing of FIG. 1.
FIG. 3 is an exploded view of an intermediate housing of FIG. 1.
FIG. 4 is an exploded view of an end housing of FIG. 1.

Referring to FIGS. 1, 2, 3 and 4, shown therein is the first embodiment of the present invention. The multirod stabilizer 2 comprises a plurality of rods 4 which extend from a base housing 6 through intermediate housing 8 and terminate at the end housing 10. The rods 4 can be made from any flexible material such as metal tubing, solid or hollow plastic rods, solid or hollow fiberglass reinforced rods, solid or hollow carbon fiber rods and composite materials such as aluminum tubing reinforced with carbon fiber and resin and preferably are made from graphite fiber. The housings 6, 8 and 10 are preferably made from plastic and can be formed by injection molding.

The base housing 6 comprises proximal portion 6*a* and distal portion 6*b*. The bores 12 are provided in both the proximal and distal portions 6*a* and 6*b* and resilient sleeves 14 are inserted into the bores 12. A mounting screw 18 is molded into the proximal portion 6*a* for mounting to a riser of an archery bow. The proximal and distal portions 6*a* and 6*b* are fastened together utilizing screws 6 which pass through screw holes in the distal end 6*b* and engage with making holes in the proximal portion 6*a*. The rods 4 extend through the bores 12 and the resilient sleeves 14. The bores 12 are larger in diameter than the rods 4 and the sleeves have a self-locking taper of preferably 7 degrees or less and have a resilience in the range of 20-60 Duros as measured on a Duro meter. Preferably, the sleeves 14 have a resilience of 50-80 Duros, particularly 60 Duros.

Similar to the base housing 6, the intermediate housing 8 comprises proximal end 8*a* and distal 8*b*, bores 20 provided in the proximal and distal ends 8*a* and 8*b*, resilient sleeves 22 provided in the bores 20 and screws 24 for fastening together the proximal and distal ends 8*a* and 8*b*. Preferably, the sleeves 22 of the intermediate housing 8 have a resiliency different than both the base and end housings 6 and 10 and is preferably 20 to 60 Duros. Still further, the bores 20 are substantially the same as the bores 12 and the sleeves 22 are substantially the same as the sleeves 14 in their construction and characteristics. Also and similar to the base housing 6, the rods 4 extend through the bores and the sleeves 22.

Similar to the base housing 6 and intermediate housing 8, the end housing 10 comprises proximal portion 10*a* and distal portion 10*b*, bores 26 provided in the proximal and distal portions 10*a* and 10*b*, resilient sleeves 28 of substantially the resiliency as the base housing are provided in the bores 26 and screws 30 for coupling together the proximal and distal ends 10*a* and 10*b*. In addition, the distal end 10*b* is provided with a coupling screw 32 for connecting a shock absorber device 34 to the distal portion 10*b*. In addition, a weight 36 can be coupled to the shock absorbing member 34. The structural and material characteristics of the bores 26 and the resilient sleeve 28 are substantially the same as those of the bores 12 and sleeve 14 of the base housing 6. In addition, an example of the shock absorbing means 34 would be a Doinker made by Leven Industries.

In assembly, the multirod stabilizer 2 of this embodiment is assembled essentially of the four rods 4, the base housing 6, intermediate housing 8 and the end housing 10. Each of the end housing 6, intermediate housing 8 and end housing 10 are substantially assembled in the same manner and accordingly, the assembly will be described in terms of an intermediate housing 8 and those differences between the end housing 10 and the base housing 6 and the assembly of the intermediate housing 8 will be described.

In particular, the rods 4 are first inserted through the sleeves 22 and the sleeves together with the rods 4 are inserted into the respective bores in the proximal end 8*a* and distal end 8*b* of the intermediate housing 8. The screws 24 are inserted into the holes in the proximal end 8*a* and are threaded into the distal end 8*b*. The tightening of the screws 24 causes the proximal end 8*a* to be drawn toward the distal end 8*b* to compress the sleeves 22 which have a self-locking taper. When the proximal end 8*a* and distal end 8*b* are completely drawn and locked together by the screws 24, the sleeves 22 are compressed and the self-locking taper thereof causes the sleeves 22 to be frictionally locked to the rods 4. As a result, even if the screws become slightly loose, the intermediate housing 8 does not move on the rods 4.

In addition, the proximal end 6*a* of the base housing 6 is provided with the bolt 18 which can be molded into the proximal end 6*a* for attaching the multirod stabilizer 2 to the rise of a bow. Similarly, the distal end 10*b* of the end housing 10 is provided with a bolt 32 which can be molded into the distal end 10*b* in order to attach the shocking absorbing device 34 to the end of the multirod stabilizer. Still further and to further isolate the rods 4 from the end housing 10 and the base housing 6, before the ends of the rods 4 are inserted into the base housing 6 and the end housing 10, the rods 4 can be additionally inserted into resilient caps which further isolate the rods 4 from the housings and prevent any direct contact therewith.

In operation, the multirod stabilizer affixed to the rise of an archery bow absorbs and dissipates the vibrational energy created during the shot of an arrow by the archery bow. The vibration travels from the rims to the rise and out through the multirod stabilizer 2 to dampen the vibration.

Figure 5:
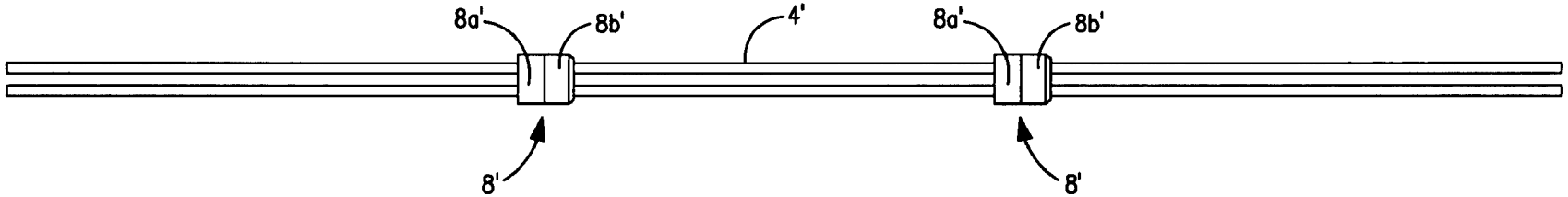
FIG. 5 is an assembled view of substantially the same embodiment of FIG. 1 except that FIG. 5 includes only two rods.
Figure 6:
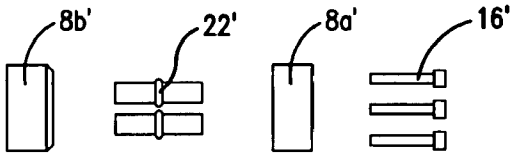
FIG. 6 is an exploded view of an intermediate housing of FIG. 5.
Figures 7, 8, 9, 10:
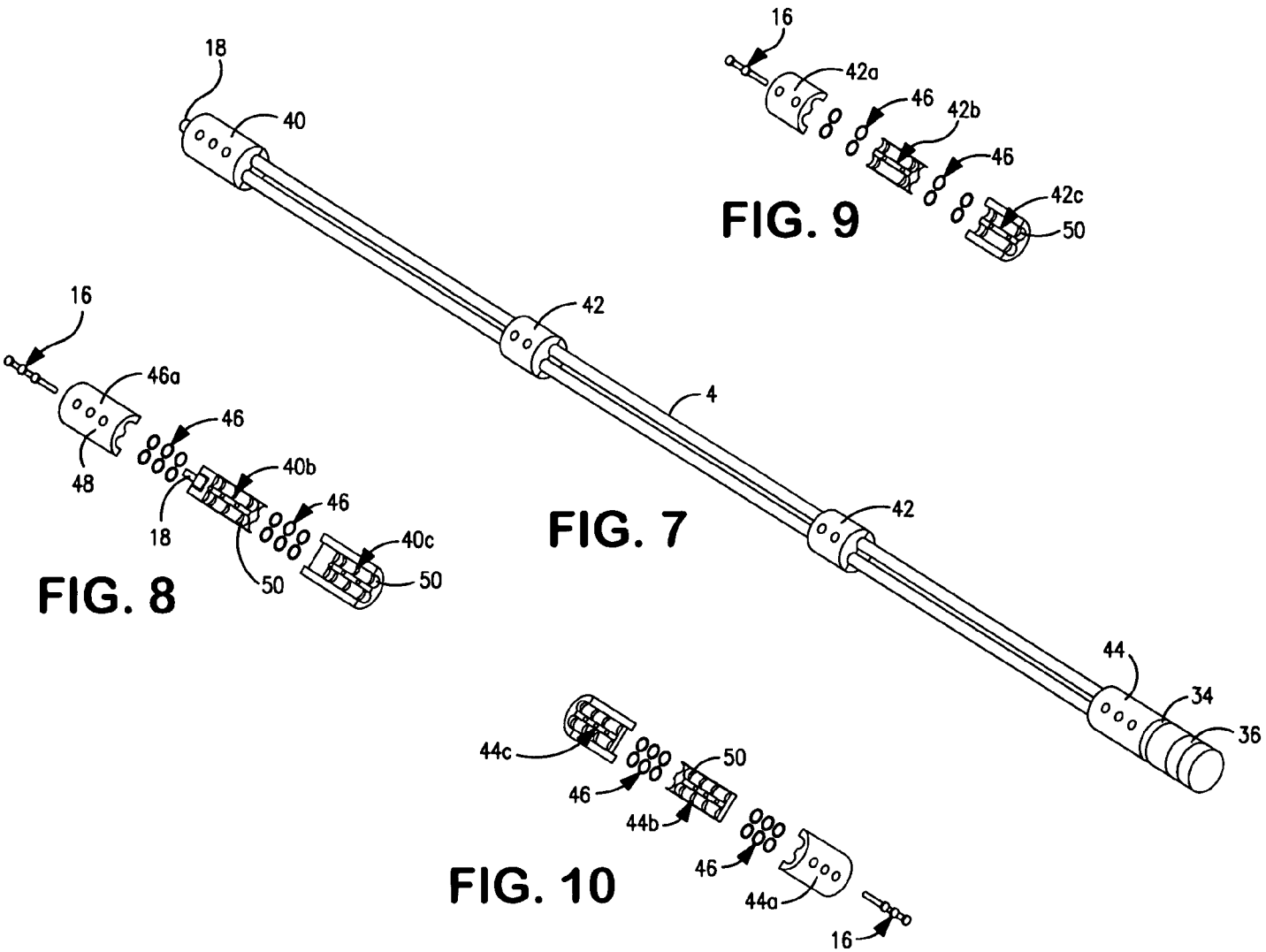
FIG. 7 is an assembled view of a second embodiment of a multirod stabilizer in accordance with the present invention.
FIG. 8 is an exploded view of the end housing of the embodiment of FIG. 7.
FIG. 9 is an exploded view of an intermediate housing of the embodiment of FIG. 7.
FIG. 10 is an exploded view of an end housing in accordance with the embodiment of FIG. 7.
Figures 11, 12, 13, 14:
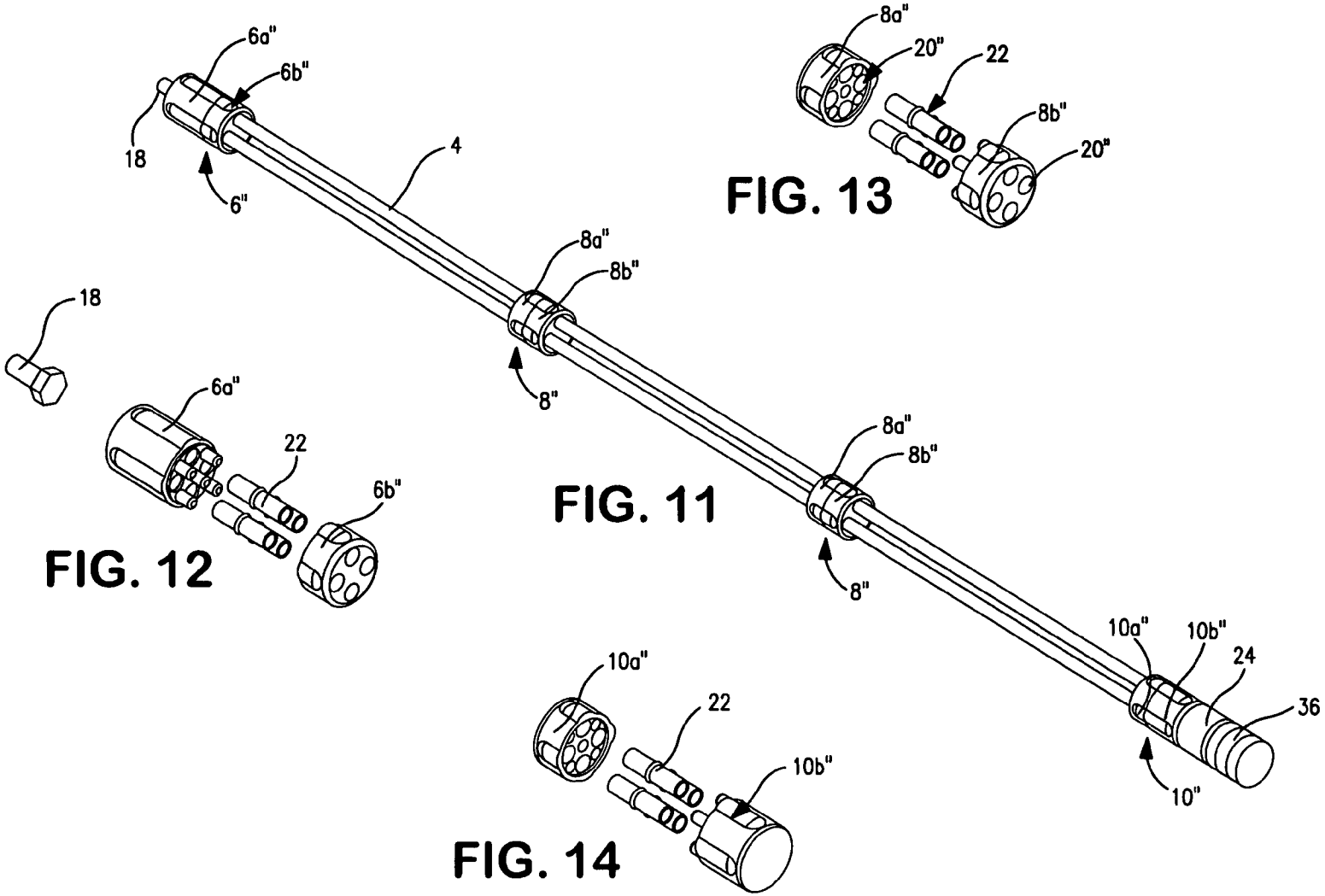
FIG. 11 is a view of a fourth embodiment of the present invention.
FIG. 12 is an exploded view of the face portion of FIG. 11.
FIG. 13 is an exploded view of an intermediate portion of the embodiment of FIG. 11.
FIG. 14 is an exploded view of the end portion of the embodiment of FIG. 11.

Referring to FIGS. 5 and 6, shown therein is a second embodiment of the multirod stabilizer of the present invention. In this second embodiment, only two rods are utilized. Accordingly, the rods 4' are inserted through bores in the proximal and distal portions 8*a'* and 8*b'* and through the sleeves 22'. In addition, screws 16' are used to couple together the proximal and distal ends 8*a'* and 8*b'*. Except for the fact that there are only two rods 4', two bores and two sleeves 22', the embodiment of FIGS. 5 and 6 is constructed substantially the same as that of FIGS. 1-4.

Referring to FIGS. 7, 8, 9 and 10, shown therein is a third of the embodiment of the present invention. In this third embodiment, again four rods 4 are utilized. However, the housings instead of being divided transversely of the rods are divided longitudinally of the rods and are provided in three pieces. In particular, the multirod stabilizer of this third embodiment comprises a base housing 40, intermediate housing 42 and the end housing 44 which enclose the four rods 4. In this third embodiment, each of the housing 40, 42, 44 are divided into left, middle and right portions a, b, c. Longitudinally extending grooves for the rods 4 are provided in each one of the left, central and right pieces a, b, c. Radially extending screw holes 48 are provided through the left, center and right pieces a, b, c so as to be able to couple together the three pieces by means of the screws 16. In addition, the longitudinally extending grooves in the respective sections of the housings are provided O-ring grooves 50. There are three such grooves 50 provided in the longitudinally extending grooves in the base housing 40 and the end housing 44 and only two provided in the intermediate housing 42. These grooves in the base and end housings 40 and 44 are provided at the ends of the longitudinal grooves and at the intermediate point of each of the grooves. In the intermediate housing 42, the grooves are provided at the ends of the longitudinal grooves provided in the housing pieces a, b, and c. Into these grooves 50 and fitted compression O-rings 46. The inner diameter of the compression O-rings 46 is approximately the same as the outer diameter of the rods 4 and when the central piece b is fitted to either the right or left pieces a and c, essentially there are formed longitudinally extending bores with a diameter slightly bigger than the diameter of the rods 4. In some constructions, the grooves 50 can be omitted and the O-rings 46 can be placed in any position and number.

In assembly, the O-rings 46 are provided in the grooves 50 and the three pieces a, b, and c are loosely assembled together with a screw 16 inserted into the hole 48. The rods 4 are then inserted through the bores formed in each of the housings 40, 42 and 44 and at the same time inserted through the O-rings 46. The screws 16 are then tightened and the three pieces a, b and c of each of the housings 40, 42, 44 are drawn together to compress the O-rings 46. The base and end housings 40 and 44 are completely assembled by tightening down the screws 16 until the O-rings 46 are completely compressed and engaged with the rods 4. The intermediate housings 42 are then moved to the portions of the rod 4 wherein they will provide the most damping effect of any vibration traveling on the multirod stabilizer. At this point, they are also connected together by tightening down the screws 16. Once all the screws 16 are completely tightened, the position of all of the housings 40, 42 and 44 is fixed and immovable. As a result, when the multirod stabilizer is affixed to the riser of an archery bow by means of the screws 18, the multirod stabilizer will substantially absorb all of the vibration generated by the archery bow when an arrow is shot and provide a stable shot for the archer.

Referring to FIGS. 11, 12, 13 and 14, shown therein is a fourth embodiment in the present invention. This fourth embodiment is similar to that of FIGS. 1-4 except this fourth embodiment does not utilize any screws 16 to couple together the portions of the housings. Instead, the portions of the housings are bonded together utilizing an adhesive while each of the housing portions is being held in compression. In all other ways, it is substantially the same as the first embodiment of FIGS. 1-4.

In particular, the rods 4 extend through the sleeves 22 which are provided in the bores of the proximal ends a and distal ends b, but the proximal ends a and distal ends b are held together with an adhesive therebetween by a compression tool to compress the self-locking sleeve 22 while the adhesive polymerizes or drys. In this way the proximal end and distal end a and b are coupled together without the utilization of the screws and cannot come apart and effect the performance of the multirod stabilizer.

It should be apparent to those skilled in the art that various embodiments of the present invention represent only a few of the various embodiment and variation of the present invention which could be made without departing from the spirit and scope of the present invention.

I claim:

1. A stabilizer for an archery bow comprising:

at least a base housing, said base housing having coupling means for coupling said base housing to a riser of said archery bow;

a plurality of longitudinally extending bores provided in said housing;

a plurality of rods, an end of each of said plurality of rods being inserted into said one of said plurality of longitudinal bores in said base housing wherein a diameter of each of said plurality of rods is less than a diameter of each of said plurality of longitudinal bores;

a resilient means provided in each of said plurality of bores surrounding each of said plurality of rods, each of said resilient means being in compression so as not only to engage an inside surface of said bore but also to engage an outside surface of said rod such that said outside surface of said rod does not directly engage with said inside surface of said bore;

an end housing, said end housing having coupling means for coupling said end housing to a weight or vibration absorbing device;

a plurality of longitudinally extending bores provided in said end housing;

an end of each of said plurality of rods being inserted into one of said plurality of longitudinally extending bores in said end housing wherein a diameter of each of said plurality of rods is less than a diameter of each of said plurality of longitudinal bores; and a resilient means provided in each of said plurality of bores in said end housing surrounding each of said plurality of rods, each of said resilient means being in compression so as not only to engage an inside surface of said bore but also to engage an outside surface of said rod such that said outside surface of said rod does not directly engage with said inside surface of said bore;

at least one intermediate housing, said at least one intermediate housing having a plurality of longitudinally extending bores provided therein;

each of said plurality of rods being extended through one of said plurality of longitudinal bores in said intermediate housing wherein a diameter of each of said plurality of rods is less than a diameter of each of said plurality of longitudinally extending bores;

a resilient means provided in each of said plurality of bores in said intermediate housing surrounding each of said plurality of rods, each of said resilient means being in compression so as not only to engage an inside surface of said bore but also to engage an outside surface of said rod such that said outside surface of said rod does not directly engage with said inside surface of said bore; and wherein said resilient means comprises a self-locking taper compression sleeve.

2. A stabilizer for an archery bow comprising:

at least a base housing, said base housing having coupling means for coupling said base housing to a riser of said archery bow;

a plurality of longitudinally extending bores provided in said housing;

a plurality of rods, an end of each of said plurality of rods being inserted into said one of said plurality of longitudinal bores in said base housing wherein a diameter of each of said plurality of rods is less than a diameter of each of said plurality of longitudinal bores, said end of each of said plurality of rods further not directly engaging with said base housing;

a resilient means provided in each of said plurality of bores surrounding each of said plurality of rods, each of said resilient means being in compression so as not only to engage an inside surface of said bore but also to engage an outside surface of said rod such that said outside surface of said rod does not directly engage with said inside surface of said bore;

an end housing, said end housing having coupling means for coupling said end housing to a weight or vibration absorbing device;

a plurality of longitudinally extending bores provided in said end housing;

an end of each of said plurality of rods being inserted into one of said plurality of longitudinally extending bores in said end housing wherein a diameter of each of said plurality of rods is less than a diameter of each of said plurality of longitudinal bores, said end of each of said plurality of rods further not directly engaging with said end housing;

a resilient means provided in each of said plurality of bores in said end housing surrounding each of said plurality of rods, each of said resilient means being in compression so as not only to engage an inside surface of said bore but also to engage an outside surface of said rod such that said outside surface of said rod does not directly engage with said inside surface of said bore;

at least one intermediate housing, said at least one intermediate housing having a plurality of longitudinally extending bores provided therein;

each of said plurality of rods being extended through one of said plurality of longitudinal bores in said intermediate housing wherein a diameter of each of said plurality of rods is less than a diameter of each of said plurality of longitudinally extending bores; and a resilient means provided in each of said plurality of bores in said intermediate housing surrounding each of said plurality of rods, each of said resilient means being in compression so as not only to engage an inside surface of said bore but also to engage an outside surface of said rod such that said outside surface of said rod does not directly engage with said inside surface of said bore; and wherein each of said base, end and intermediate housings comprises at least two portions with said plurality of rods extending therethrough and coupling means for coupling said two portions together to hold said resilient means in compression.

3. The stabilizer of claim 2 wherein each of said coupling means is selected from the group consisting of screws, adhesives and a combination thereof.

4. The stabilizer of claim 2 wherein said two portions extend longitudinally of said stabilizer.

5. The stabilizer of claim 2 wherein two portions extend transversely of said stabilizer.

6. A stabilizer for an archery bow comprising:

at least a base housing, said base housing having coupling means for coupling said base housing to a riser of said archery bow;

a plurality of longitudinally extending bores provided in said housing;

a plurality of rods, an end of each of said plurality of rods being inserted into said one of said plurality of longitudinal bores in said base housing wherein a diameter of each of said plurality of rods is less than a diameter of each of said plurality of longitudinal bores, said end of each of said plurality of rods further not directly engaging with said base housing;

a resilient means provided in each of said plurality of bores surrounding each of said plurality of rods, each of said resilient means being in compression so as not only to engage an inside surface of said bore but also to engage an outside surface of said rod such that said outside surface of said rod does not directly engage with said inside surface of said bore;

an end housing, said end housing having coupling means for coupling said end housing to a weight or vibration absorbing device;

a plurality of longitudinally extending bores provided in said end housing;

an end of each of said plurality of rods being inserted into one of said plurality of longitudinally extending bores in said end housing wherein a diameter of each of said plurality of rods is less than a diameter of each of said plurality of longitudinal bores, said end of each of said plurality of rods further not directly engaging with said end housing; and a resilient means provided in each of said plurality of bores in said end housing surrounding each of said plurality of rods, each of said resilient means being in compression so as not only to engage an inside surface of said bore but also to engage an outside surface of said rod such that said outside surface of said rod does not directly engage with said inside surface of said bore; and wherein each of said base and end housing comprises at least two portions with said plurality of rods extending therethrough and coupling means for coupling said two portions together to hold said resilient means in compression.

7. The stabilizer for an archery bow according to claim 6 further comprising:

at least one intermediate housing, said at least one intermediate housing having a plurality of longitudinally extending bores provided therein;

each of said plurality of rods being extended through one of said plurality of longitudinal bores in said intermediate housing wherein a diameter of each of said plurality of rods is less than a diameter of each of said plurality of longitudinally extending bores; and a resilient means provided in each of said plurality of bores in said intermediate housing surrounding each of said plurality of rods, each of said resilient means being in compression so as not only to engage an inside surface of said bore but also to engage an outside surface of said rod such that said outside surface of said rod does not directly engage with said inside surface of said bore.

8. The stabilizer of claim 6 wherein said two portions extend longitudinally of said stabilizer.

* * * * *